US005923311A

United States Patent [19]

Edwards

[11] Patent Number: 5,923,311

[45] Date of Patent: Jul. 13, 1999

[54] MATRIX DISPLAY DEVICES

[75] Inventor: Martin J. Edwards, Crawley, United Kingdom

[73] Assignee: U.S. Philips Corporation, New York, N.Y.

[21] Appl. No.: 08/762,686

[22] Filed: Dec. 11, 1996

[30] Foreign Application Priority Data

Dec. 15, 1995 [GB] United Kingdom ..... 9525638

[51] Int. Cl.[6] ..... G09G 3/36

[52] U.S. Cl. ..... 345/92; 345/90

[58] Field of Search ..... 345/87, 92, 90, 345/93, 67

[56] References Cited

U.S. PATENT DOCUMENTS 5,095,304 3/1992 Young ..... 345/92
5,333,004 7/1994 Mourey et al. ..... 345/92
5,424,752 6/1995 Yamazaki et al. ..... 345/92

FOREIGN PATENT DOCUMENTS

0597536A2 5/1994 European Pat. Off. .

*Primary Examiner*—Matthew Luu
*Attorney, Agent, or Firm*—F. Brice Faller

[57] ABSTRACT

A matrix display device having an array of picture elements (12) which each comprise a serial charge redistribution D to A converter circuit that includes two transistors (30, 31) and two capacitors (34, 35), at least one of which comprises an electro-optic, e.g. liquid crystal, display element, and which are driven by switching signals and digital data signals from a drive circuit (21, 25) via row and column address conductors (18, 19) respectively. The two transistors of a picture element are of complementary type, e.g. n and p TFTs, connected to the same row conductor and operable in sequence by the switching signal on the row conductor (18). The drive circuit (21) is consequently simplified and the vertical scan direction can readily be reversed.

10 Claims, 3 Drawing Sheets

MATRIX DISPLAY DEVICES

BACKGROUND OF THE INVENTION

This invention relates to a matrix display device comprising a row and column array of picture elements connected to sets of row and column address conductors via which switching signals and serial multi-bit digital data signals respectively from a drive circuit are applied to the picture elements, and in which each picture element comprises a serial charge redistribution digital to analogue converter circuit having two switching transistors and two capacitor elements, at least one of which comprises an electro-optic display element, for converting a multi-bit digital data signal on a respective one of the column address conductors during a picture element address period to an analogue voltage for the display element, the switching transistors of the picture element being operable in sequence during the picture element address period by said switching signals.

A matrix display device of the above kind, and more particularly a liquid crystal matrix display device, is described in EP-A-0597536, to which U.S. Pat. No. 5,448,248 corresponds. The display device has a number of advantages over conventional kinds of matrix display devices in which data signals supplied by a column drive circuit via the column address conductors to the picture elements comprise analogue voltage signals, especially when the video signal supplied to the display is a digital video signal. The need to convert the digital picture information signals to analogue (amplitude modulated) signals before being applied to the column address conductors is removed. The column drive circuit can readily be implemented using purely digital circuitry thereby making it capable of operating at comparatively high speeds and of being conveniently integrated on a substrate of the display panel using thin film transistors, TFTs. The switching transistors of the picture elements comprise TFTs of one conductivity type and can be of the same kind as those used in the drive circuit and fabricated simultaneously therewith. In one embodiment, the two capacitor elements of a picture element are each constituted by a display sub-element obtained by dividing a display element into two discrete parts.

The serial charge redistribution digital to analogue circuits of the picture elements are operated in picture element address periods by turning on a first of the two TFTs, by means of a switching signal, so as to charge a first of the capacitor elements according to the first bit of the serial multi-bit data signal then present on the associated column conductor. The TFT is then turned off, by removing the switching signal, and the second TFT turned on, by means of a further switching signal, so that the charge on the one capacitor element is shared between the two capacitor elements. This TFT is then turned off and the first TFT turned on again so as to charge the one capacitor element according to the second bit of the multi-bit data signal then on the column conductor, following which the first TFT is turned off and the second TFT turned on so as to allow again charge sharing between the two capacitor elements. The cycle is repeated for all bits of the data signal such that, after the final operation of the second TFT a voltage level is obtained on the capacitor elements according to the multi-bit data signal. In order to sequentially operate the TFTs in this manner, the two TFTs of a picture element are connected respectively to two different row address conductors via which their respective switching signals are supplied from the drive circuit. The two row address conductors are shared by all the other picture elements in the same row. Each row address conductor, apart from the first and the last, is shared between two adjacent rows of picture elements with the corresponding first TFTs of the picture elements in one row being connected to one row address conductor and the corresponding second TFTs of the picture elements in an adjacent row of picture elements being connected to the same row address conductor. The sharing of row address conductors between adjacent rows of picture elements avoids the need to provide respective pairs of row address conductors for each row of picture elements, in effect doubling the number of row address conductors required, which would be undesirable, particularly if the device is used in a projection system, as the density of the picture elements and aperture of the display elements would be compromised by the presence of such additional row address conductors. However, the sharing of the row address conductors can impose limitations in operation which cause problems in certain circumstances in that the order in which the rows of picture elements can be driven, i.e. the vertical scan direction, is constrained.

OBJECTS AND SUMMARY OF THE INVENTION

It is an object of the present invention to provide an improved matrix display device of the kind described in the opening paragraph.

It is another object of the present invention to provide a matrix display device of the kind described in the opening paragraph in which the aforementioned limitations, and the problems caused thereby, can be overcome at least to some extent.

According to the present invention, a matrix display device of the kind described in the opening paragraph is characterised in that the two switching transistors of a picture element are connected to the same row address conductor and are of opposite conductivity types, the two switching transistors being operable in complementary manner by the switching signals applied to the row address conductor. The switching transistors preferably comprise p and n type TFTs. In this display device, therefore, the required switching of the two switching transistors of a picture element is controlled via just one row address conductor, rather than two as in the known device. With the switching transistors of the picture elements in a respective row preferably connected to a respective, different, one of the row address conductors, sharing of a row address conductor between picture elements in two adjacent rows is avoided. Possibly a row address conductor could be used for picture elements in two rows but this would require, for example, additional column address conductors to be provided and also complicate the column drive circuit. Although only one of the capacitor elements of a picture element need comprise a display element, preferably the two capacitor elements are each constituted by a display sub-element, as in the device known from EP-A-0597536.

The invention provides a number of advantages. The number of row address conductors required, one per row of picture elements, remains the same as in the known device (apart from the two additional conductors needed for the first and last rows of picture elements in the known device), but because the two switching transistors, e.g. p and n type TFTs, of each of the picture elements in a row are no longer connected to two different row address conductors, greater freedom in the layout of the components of the picture element circuit is allowed. Also both TFTs of a picture element can be controlled to switch in sequence by a single signal on the row address conductor. Assuming that the input TFT of the serial charge redistribution circuit, i.e. the first TFT as described above, is an n-type TFT and the other, second, TFT that is operable to share the charge on the one capacitor element between the two capacitor elements is a p type TFT, then by taking the row address conductor to a high potential the first TFT is turned on to charge the first capacitor element, according to the bit present on the column address conductor, and the second TFT is held off. When the row address conductor is returned to a low, or zero, potential the first TFT is turned off and the second TFT turned on to effect charge sharing. Thus, merely by switching the row address conductors between a high and a low potential level both TFTs are operated in sequence in the required manner. The potential on the one row conductor therefore only needs to be switched a number of times, dependent on the number of bits, to switch the TFTs in sequence and perform the required D to A conversion. As a consequence the row drive circuit can be much simpler than that of the device of EP-A-0597536 which needs to provide a series of switching signals, corresponding in number to the number of bits in the multi-bit data signal, to each of the two adjacent row address conductors in synchronised manner to drive a picture element.

A further, and important, advantage of the invention is that it overcomes an operational limitation found with the display device of EP-A-0597536. Because in this known device each row of picture elements is operated by two row address conductors and each row address conductor is used by two adjacent rows of picture elements, the vertical scan direction cannot be reversed without corrupting the intended display when the capacitor elements both comprise display sub-elements. If the array of picture elements was to be driven from bottom to top rather than top to bottom then the input TFT of the conversion circuit of a picture element in one row would be turned on after the conversion process for that row had been completed when the picture elements in the above row are addressed, thereby causing the stored voltage to be altered. In the display device of the invention, on the other hand, each row of picture elements is driven via a respective row address conductor and the vertical scan direction can readily be reversed. This capability can be useful in a number of applications. For example, projection display systems using a matrix display device are known which are designed so that they can be either floor mounted or ceiling mounted in an inverted orientation. As the vertical scan can readily be reversed, the display device is suitable for use in such an application. A similar requirement is found in car navigation systems where the display may need to be mounted above or below the dashboard.

In a preferred arrangement, the drive circuit is operable to drive the picture elements in each row in turn by cyclically switching a row address conductor between high and low potential levels in a respective row address period to operate the switching transistors of the picture elements in the row and by applying the bits of the multi-bit data signals to the picture elements via their associated column address conductors in sequence in the row address period. In order for the picture elements to operate properly, their capacitor elements need to be reset prior to the picture elements being driven with the multi-bit data signals. Conveniently, therefore, the drive circuit may be arranged to apply the multi-bit data signals to the picture elements during a latter part of the row address period and to apply during a preceding part of the row address period a predetermined voltage to the column address conductors for setting the capacitor elements of the picture elements to a certain level. Resetting of the capacitor elements might be accomplished in other ways but these would likely entail using additional TFTs and as such would be less preferable.

Polysilicon TFTs can be used for the complementary, p and n type, TFTs of the picture elements. Display devices having row and column drive circuits integrated on the display panel and comprising digital circuits using p and n type TFTs are known and the provision, therefore, of the two types of TFTs in the picture elements would not unduly complicate fabrication of the device.

The display elements are preferably liquid crystal display elements. Other kinds of electro-optic display elements exhibiting capacitance could, however, be used.

BRIEF DESCRIPTION OF THE DRAWINGS

An embodiment of a matrix display device in accordance with the present invention will now be described, by way of example, with reference to the accompanying drawings, in which.

The same reference numerals are used throughout the Figures to denote the same or similar parts.

DESCRIPTION OF THE PREFERRED EMBODIMENTS

Figure 1:
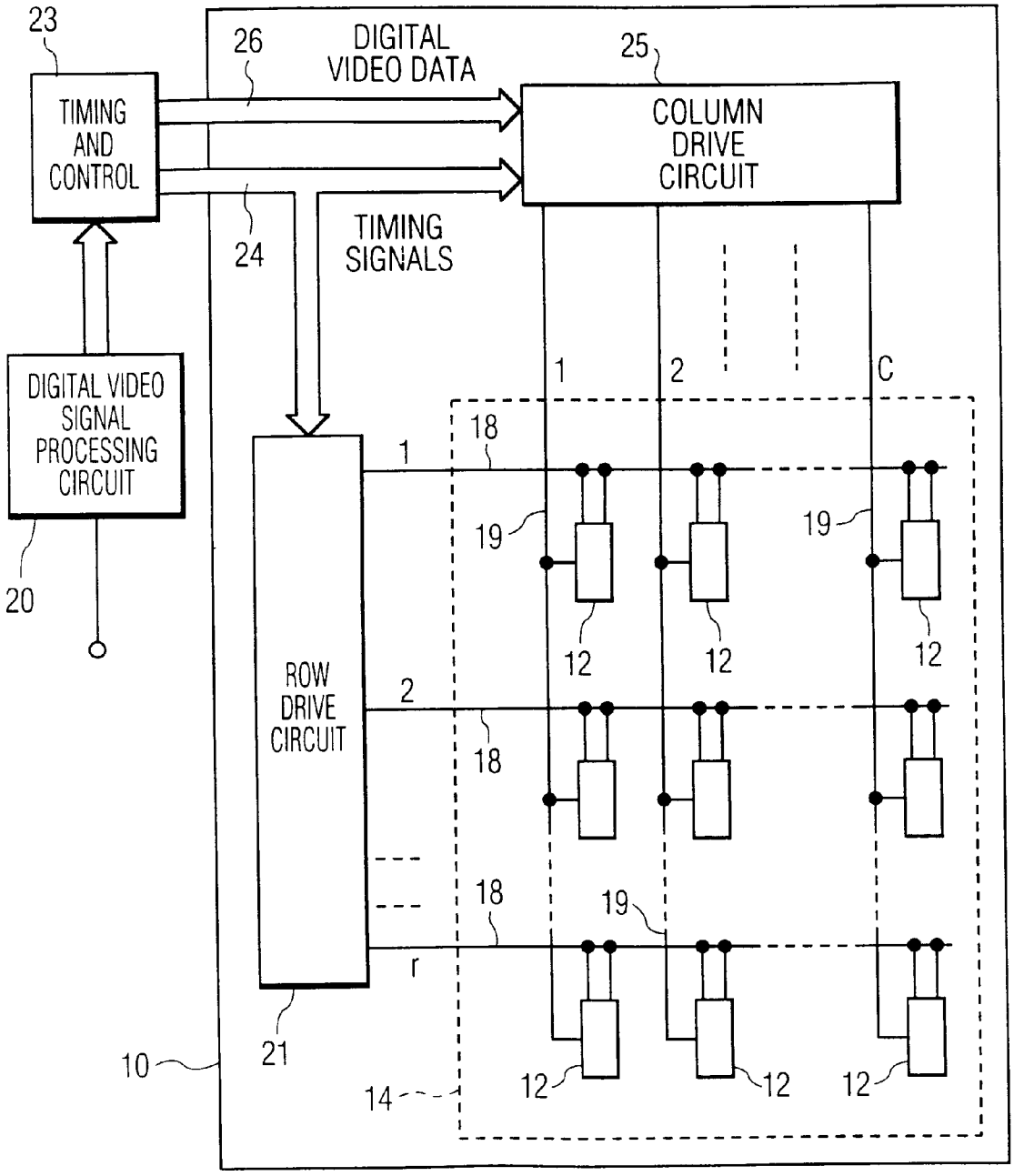
FIG. 1 is a schematic block diagram of an embodiment of matrix display device according to the invention.

Referring to FIG. 1, the matrix display device comprises a liquid crystal display device having a row and column array of picture elements 12 formed in a display panel 10 and defining a display area 14. The picture elements 12 include capacitive liquid crystal display elements formed by spaced electrodes carried respectively on the opposing surfaces of first and second spaced glass substrates with twisted nematic liquid crystal material therebetween. The display element electrodes on the first substrate comprise respective portions of a electrode layer common to all display elements in the array while the other electrodes of the display elements comprises individual electrode layers carried on the second substrate together with their addressing circuitry.

The picture elements 12 are connected to sets of row (l to r) and column (l to c) address conductors 18 and 19 carried on the second substrate to which drive signals for driving the picture elements are supplied from a peripheral drive circuit comprising a row drive circuit 21 and a column drive circuit 25 both of which comprise digital circuitry and are integrated on the display panel 10. The row drive circuit 21 is operable to scan the rows of picture elements in turn in each field period via the row conductors by applying switching waveform signals to the row conductors, which operation is repeated for successive fields, and is controlled by timing signals provided along a bus 24 from a timing and control circuit 23 to which a digital video signal is supplied from a digital video signal processing circuit 20. The input to the circuit 20 can be either analogue or digital, e.g. a TV signal or a video signal from a computer system. The column drive circuit 25 is supplied with digital video (picture) data from the circuit 23 along a bus 26 and operates to apply to the set of column conductors 19, appropriately in parallel for the respective picture elements in a row, and in synchronism with scanning of the rows, data signals in a serial multi-bit digital form. The digital video data signal supplied to the column drive circuit 25 is demultiplexed and samples from a complete line of video information are stored in latch circuits of the circuit 25 as appropriate to their associated column of picture elements. As in conventional display devices, the writing of video information to the picture elements takes place on row by row basis in which a line of video information is sampled by the column device circuit 25 and subsequently written to the picture elements 12 in a selected row via the column conductors, the identity of the selected row being determined by the row drive circuit 21. Unlike conventional display devices, however, the video information supplied to a picture element is in a serial multi-bit digital form rather than analogue (amplitude modulated) form.

The peripheral drive means is similar to that of the display device described in EP-A-0597536 to which reference is invited for further information and whose disclosure is incorporated herein. Also as in that device, the picture elements 12 in the present display device each comprise a serial charge redistribution digital to analogue conversion circuit which operates to convert the serial multi-bit digital data signals applied thereto via the associated column conductor 19 to appropriate analogue, amplitude modulated, voltages for use by the display element. Whereas in the device of EP-A-0597536 the picture elements in each row are each connected to, and driven via, two row address conductors, each row of picture elements in this display device is, as shown in FIG. 1, connected to just one row address conductor 18 and each row address conductor is associated with just one row of picture elements.

Figure 2:
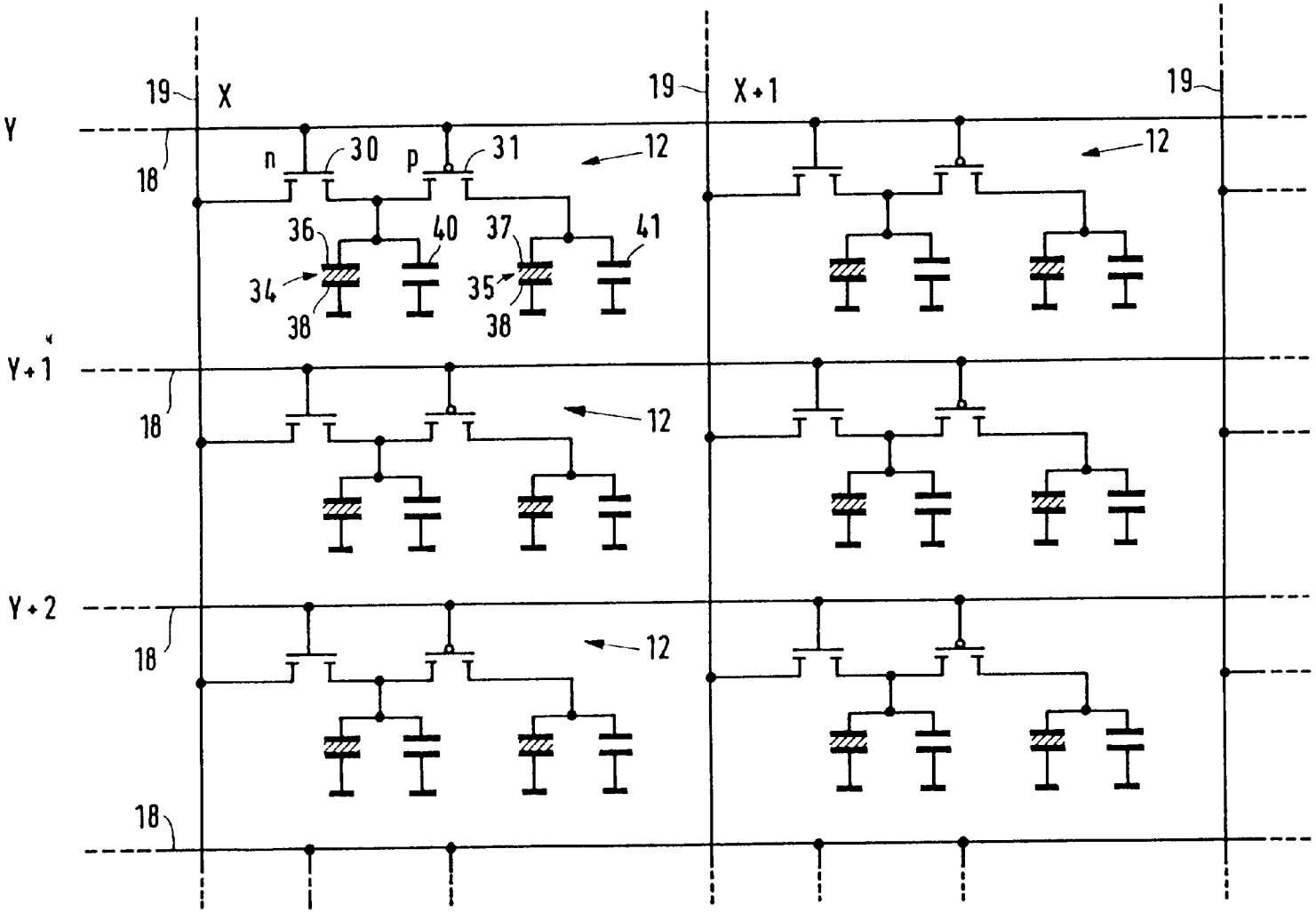
FIG. 2 shows schematically the circuit configuration of a typical part of the picture element array in the device of FIG. 1.

FIG. 2 illustrates the circuit of a typical group of adjacent picture elements 12 in the array, the particular group comprising six picture elements 12 from three rows, Y, Y+1 and Y+2, and two columns, X and X+1. The picture elements 12 are located adjacent the intersections between respective row and column conductors 18 and 19 with the picture elements 12 in one column sharing a respective column conductor 19 and the picture elements 12 in one row sharing a respective row conductor 18.

Each picture element comprises two polysilicon, enhancement type, TFTs 30 and 31. The TFTs 30 and 31 are of opposite conductivity, complementary types, namely n and p type respectively, whose gates are connected to the associated address conductor 18. The source of the TFT 30 is connected to the associated column conductor 19 while its drain is connected to both the source of the TFT 31 and to the first electrode 36 of a display subelement 34. The drain of the TFT 31 is connected to the first electrode 37 of a second display sub-element 35. The display sub-elements 34 and 35 together constitute the aforementioned display element of the picture element and are formed by dividing the display element electrode carried on the second substrate of the display panel, also carrying the TFTs and the address conductors, into two discrete parts, 36 and 37 respectively which are substantially the same in area and which, together with respective portions of the common electrode, here referenced 38, on the opposing, first, substrate, which portions constitute their second electrodes, define the two, discrete, display sub-elements. The two sub-elements 34 and 35 are of substantially equal capacitance value. The circuit arrangement of the display sub-elements (capacitors) 34 and 35 and the TFTs 30 and 31 constitutes a serial charge redistribution digital to analogue converter circuit.

In this particular embodiment the display panel is of a kind in which storage capacitors are provided for the display elements. The storage capacitor for each picture element is similarly divided into two discrete capacitor elements of substantially equal value, each being associated and connected in parallel with a respective display sub-element as shown at 40 and 41.

The general operation of a serial charge redistribution circuit in performing the digital to analogue conversion is described in EP-A-0597536. Briefly, and with regard to the circuit of the picture element at the intersection of row Y and column X in FIG. 2, then, assuming the display sub-elements 34 and 35, and their associated storage capacitors 40 and 41, are initially discharged, conversion is achieved following a number of cycles in which the TFTs 30 and 31 are operated sequentially in a complementary manner. During each cycle a voltage is applied to the input of the circuit, i.e. the source of the TFT 30, via the column conductor 19 which voltage takes one of two values representing the state of one bit (0 or 1) of the serial multi-bit data which is to be converted. The voltages representing all the bits of the multi-bit data are presented during respective successive cycles serially with the least significant bit first. In each cycle, the TFT 30 is turned on so that the display sub-element 34, and its associated capacitor 40, is charged according to the voltage level then existing on the column conductor 19, representing the first bit. Thereafter the TFT 30 is turned off and the TFT 31 is turned on whereby the charge on the sub-element 34, and the parallel connected capacitor 40, is shared between the sub-elements 34 and 35 and their associated capacitors 40 and 41. The TFT 31 is then turned off. This cycle of operation is repeated in successive cycles in which respective successive voltages are applied to the column conductor 19 representing each bit of the serial multi-bit data in turn. During this operation, the common electrode 38 of the display panel is held at a constant reference potential which may, for example, be ground. The number of cycles corresponds to the number of bits in the serial multi-bit data for a picture element and this in turn determines the grey-scale resolution. Following the last cycle, a final voltage is obtained on the display sub-elements 34 and 35 whose magnitude represents the analogue equivalent of the digital data and which produces the corresponding grey-scale level output from the display element.

The TFTs of each of the picture elements 12 in a row are driven in this manner at the same time, during a respective row address period, to perform such conversion by means of row scan waveform signal, comprising gating signals for switching the TFTs, applied to their associated row conductor 18 by the row drive circuit 21. A similar waveform is applied to each row conductor 18 in turn in respective, subsequent, row address periods so as to drive each row of picture elements in turn. An example of the row waveforms applied to three successive row conductors, e.g. for the rows Y, Y+1 and Y+2, is shown schematically in FIG. 3 together with an example of the waveform, Vd, representing the serial multi-bit data signals, applied to a column address conductor 19 for the column X.

Figure 3:
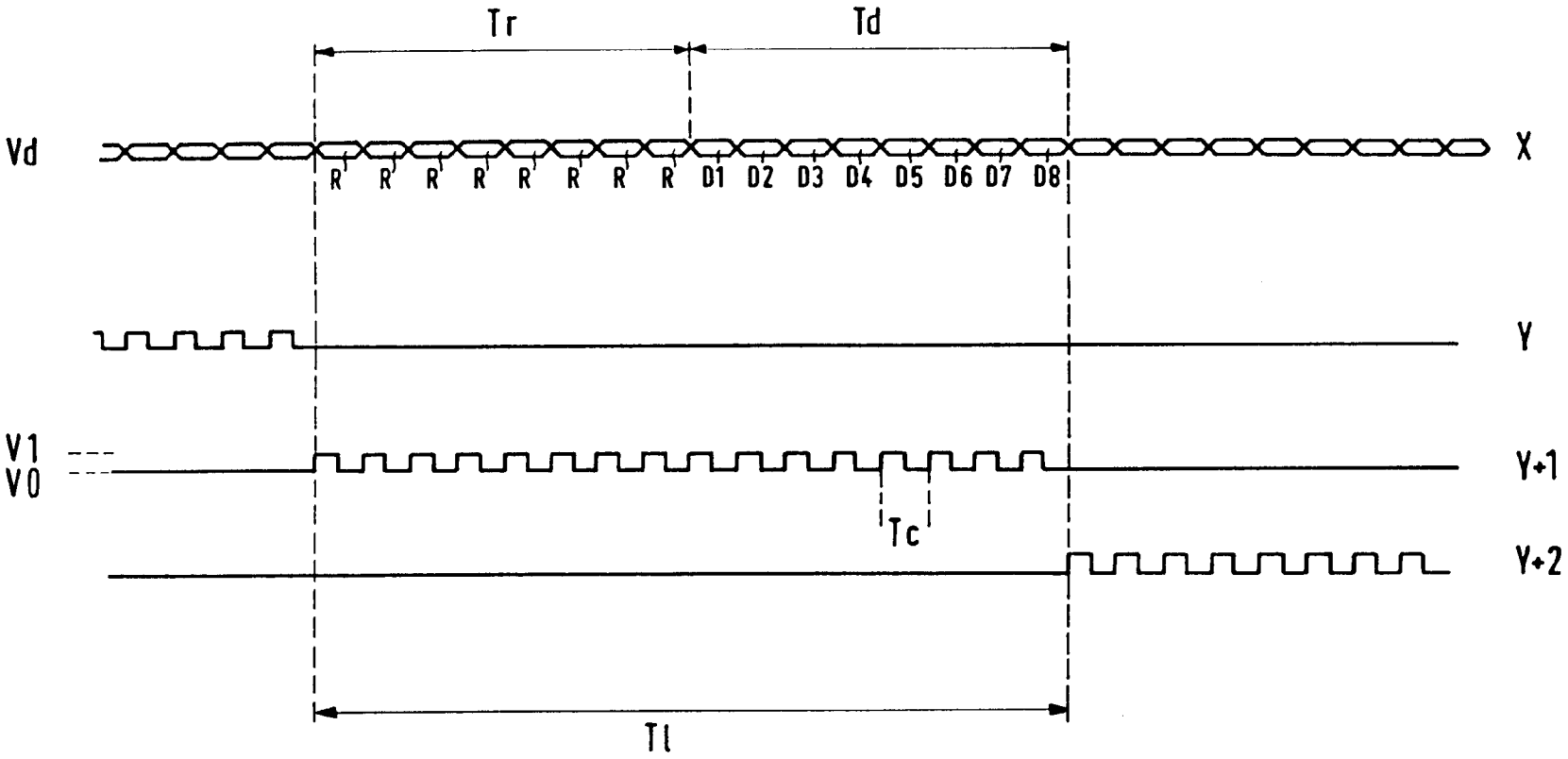
FIG. 3 illustrates example waveforms applied to row and column address conductors of the display device for driving the picture elements.

Each row of picture elements 12 is addressed in a respective row address period, $T_L$, corresponding to a video line period, e.g. 64 $\mu$s, FIG. 3 showing in full the address period for row Y+1, during which the potential on the row conductor 18 is switched between a succession of high and low values $V_1$ and $V_0$ constituting gating signals for the TFTs 30 and 31 respectively. During the period when the row of picture elements is not being addressed, corresponding to the remainder of the field period of the display, the row conductor 18 is held at the low potential level $V_0$. When the potential on the row conductor is high, $V_1$, the TFTs 30 and 31 of a picture element are turned on and off respectively and when the potential on the row conductor is low, $V_0$, the TFTs 30 and 31 are turned off and on respectively. As described previously, when the TFT 30 is turned on the display sub-element 34 is charged according to the bit—representing data voltage level on its associated column conductor and when the TFT 31 is turned on, with the TFT 30 turned off, the TFT 31 allows charge sharing between the two display sub-elements 34 and 35. Thus, the required, complementary, switching of the TFTs 30 and 31 in sequence when performing a digital to analogue conversion is obtained merely by switching the voltage on the row conductor 18 to a high potential cyclically, each cycle in the conversion only requiring in effect one pulse signal of potential $V_1$ on the row conductor. One typical cycle is shown at $T_c$. In the example illustrated in FIG. 3, each row address period $T_L$ comprises sixteen consecutive cycles, $T_c$. The latter eight cycles, in the period $T_d$, are utilised for the conversion process while the initial eight cycles are utilised to reset the display sub-element and storage capacitor voltages, by discharging the display sub-elements and their associated storage capacitors, to a predetermined level in a reset period $T_r$, where $T_r=T_L-T_d$, prior to the conversion taking place in the period $T_d$. During each cycle a certain voltage is applied to the column conductor, as shown in FIG. 3. In the latter eight cycles the series of voltages applied to the column conductor represent the respective bits of the serial multi-bit data to be converted, as determined by the circuit 25, and are here denoted by D1 to D8, there being eight bits in this particular example. During the reset period, Tr, constituted by the first eight cycles, a predetermined reset voltage level is applied, during each cycle, as denoted at R. The value of the reset voltage R would change in successive fields if the drive voltages for the picture elements are inverted in successive fields in the conventional manner. Each time the row conductor potential is switched, i.e. through each cycle $T_c$ in the period $T_r$, the difference between the display subelements, voltage and the reset voltage R is reduced by a factor of two. At the end of these eight cycles the voltage on the display sub-elements is at the desired level substantially equal to the level of the reset voltage R. The number of cycles likely to be required to achieve this can be calculated, based on the worst case for the initial voltage. In practice, the number of cycles needed is likely to be less than eight.

At the termination of the row address period $T_L$, the TFT 30 is held off preventing the voltage on the display sub-elements being affected by subsequent voltages appearing on the column conductor 19. Although the TFT 31 remains on for the remainder of the field period, this has no affect and merely ensures that the voltages on the two display sub-elements remain substantially the same. Each row of picture elements is addressed in this manner during a respective row address period, the operation being repeated in successive field periods.

With this scheme, the switching time of the row waveform signal should be sufficiently fast that current flowing through the TFTs 30 and 31 of a picture element as the gate voltage is changing does not significantly alter the voltage on the display sub-elements, bearing in mind that as one TFT is turning on the other is turning off. To this end, the RC time constant of the row conductors 18 and the rise and fall time of the pulse signal ($V_1$) at the output of the row drive circuit 21 are designed to be sufficiently small.

It will be appreciated from the foregoing that the row waveform signal provided by the row drive circuit 21 to operate the serial charge redistribution circuits of the picture elements is relatively simple, comprising merely a succession of voltage pulse signals. As a consequence, the row drive circuit 21 is less complicated than that required in the device known from EP-A-0597536 in which the two TFTs in each picture element in a row are connected to respective different row address conductors and consequently the row drive circuit needs to supply synchronised gating pulse signals to the two row conductors when addressing a row of picture elements. Moreover, unlike that known device it is readily possible to reverse the vertical scan direction in the device described above should this be required. Switching signals on a row conductor associated with one row of picture elements have no affect on other rows of picture elements Although in the above-described embodiment serial multi-bit data signals comprising eight bits are supplied via the column conductors to the picture elements, it will be apparent that the number of bits can be varied. For example, 6 or 4 bits may be used if a lower resolution capability is acceptable.

Various other modifications are possible as described in EP-A-0597536. For example, the display device may be a full colour display device in which a three colour (R, G, B) micro-filter array is associated with the picture element array in conventional manner and in which the column drive circuit 25 is suitably modified. Also, the two display sub-elements 34 and 35 could be designed to have different areas, and hence capacitances, rather than being substantially equal in order, for example, to compensate for the effects of any parasitic capacitances in the picture element circuit.

The voltage values applied to the column conductors 18 and representing the bits of the serial multi-bit data need not comprise only two levels. In order to address the picture element with positive and negative signals, the two levels used in one field period may differ from those used in the next, with the levels used in alternate fields being the same. This can be achieved by means of a level shifter circuit in the column drive circuit 25. Also, the number of voltage levels used for the multi-bit data signals could be increased, for example from two to four, in order to increase the conversion resolution as described in EP-A-0597536.

The circuits 21 and 25 in the embodiment of FIG. 1 are conveniently integrated on the same, second, substrate of the panel 10 as the array of picture element circuits and address conductors 13 and 19 and fabricated simultaneously therewith. However, they could be provided separately and mounted on the panel by, for example, a chip on glass technique.

While the invention has been described in relation to a liquid crystal display device, it is envisaged that other kinds of electro-optic display elements exhibiting capacitance may be used instead.

In summary, therefore, the matrix display device described above has an array of picture elements which each comprise a serial charge redistribution D to A converter circuit that includes two transistors and two capacitors at least one of which comprises an electro-optic, e.g. liquid crystal, display element, and which are driven by switching signals and digital data signals from a drive circuit via row and column address conductors respectively. The two transistors of a picture element are of complementary type, e.g. n and p TFTs, connected to the same row conductor and operable in sequence by the switching signal on the row conductor. The drive circuit is consequently simplified and the vertical scan direction can readily be reversed.

From reading the present disclosure, other modifications will be apparent to persons skilled in the art. Such modifications may involve other features which are already known in the design, manufacture and use of systems in the field of active matrix display devices and component parts thereof and which may be used instead of or in addition to features already described herein.

I claim:

1. A matrix display device comprising:

a matrix of picture elements connected to sets of row and column address conductors, via which switching signals and multi-bit digital data signals respectively from a drive circuit are applied to the picture elements, each picture element comprising a serial charge redistribution digital to analogue converter circuit having two switching transistors and two capacitor elements, at least one of the capacitor elements comprising an electro-optic display element, the serial charge redistribution digital to analogue converter circuit of a respective picture element being adapted for converting a multibit digital data signal on a respective one of the column address conductors during a picture element address period to an analog voltage for the electro-optic display element portion thereof, the switching transistors of a respective picture element being operable in sequence during the picture element address period by the switching signals, the two switching transistors of each respective picture element being connected to the same row address conductor, being of opposite conductivity types, and being operable in complementary manner by the switching signals applied to the row address conductor.

2. A matrix display device according to claim 1, characterised in that the switching transistors of the picture elements in each said row are connected to a respective, different, one of the row address conductors.

3. A matrix display device according to claim 2, characterised in that the drive circuit is operable to drive the picture elements in each row in turn by cyclically switching a row address conductor between high and low potential levels in a respective row address period to operate the switching transistors of the picture elements in the row and by applying the bits of the multi-bit data signals to the picture elements via their associated column address conductors in sequence in the row address period.

4. A matrix display device according to claim 3, characterised in that the drive circuit is arranged to apply the multi-bit data signals to the picture elements during a latter part of the row address period and in that the drive circuit is operable to apply during a preceding part of the row address period a predetermined voltage to the column address conductors for setting the capacitor elements of the picture elements to a certain level.

5. A matrix display device according to claim 1, characterised in that the two capacitor elements of a picture element each comprise a display sub-element.

6. A matrix display device according to claim 1, characterised in that the switching transistors of a picture element comprise p and n type TFTS.

7. A matrix display device according to claim 1, characterised in that the display elements comprise liquid crystal display elements.

8. A matrix display device according to claim 1, characterised in that the two capacitor elements of a picture element each comprise a display sub-element.

9. A matrix display device according to claim 2, characterized in that the switching transistors of a picture element comprise p and n type TFTs.

10. A matrix display device according to claim 2, characterized in that the display elements comprise liquid crystal display elements.

* * * * *